US005167566A

United States Patent [19]

Novitsky et al.

[11] Patent Number: 5,167,566

[45] Date of Patent: Dec. 1, 1992

[54] MINIMIZING BRASSIERE

[75] Inventors: Rosalie M. Novitsky, Howard Beach, N.Y.; Harold Stern, Elmwood Park, N.J.; Nancy Fishman, Weston, Conn.; Miguel Cintron, Brentwood, N.Y.

[73] Assignee: Wacoal America, Inc., New York, N.Y.

[21] Appl. No.: 868,729

[22] Filed: Apr. 14, 1992

[51] Int. Cl.[5] ..... A41C 3/10; A41C 3/12

[52] U.S. Cl. ..... 450/74; 450/44; 450/45; 450/47; 450/49; 450/51; 450/52; 450/65; 450/75; 450/76; 450/86; 2/67; 2/73

[58] Field of Search ..... 2/67, 73; 450/1, 41, 450/43, 44, 45, 46, 47, 49, 51, 52, 53, 65, 66, 67, 70, 74, 75, 76, 77, 86

[56] References Cited

U.S. PATENT DOCUMENTS

| | | | |
|---|---|---|---|
| 2,286,601 | 6/1942 | Clark | 450/67 |
| 2,701,362 | 2/1955 | Cascio | 450/67 |
| 2,746,053 | 5/1956 | Krieger | 450/74 |
| 2,751,593 | 6/1956 | Alberts | 450/74 |
| 2,887,113 | 5/1959 | Gingras | 450/67 |
| 3,056,411 | 10/1962 | Child | 450/65 |
| 3,066,676 | 12/1962 | Kaupp | 450/74 X |
| 3,093,137 | 6/1963 | Dugan | 450/76 X |
| 3,173,421 | 3/1965 | Steiner | 450/74 X |
| 3,263,685 | 8/1966 | Bernfeld | 450/86 X |
| 3,392,732 | 7/1968 | Hölscher | 450/74 X |
| 3,516,415 | 6/1970 | Hadley-Webb | 450/74 X |
| 3,606,891 | 9/1971 | Marcario et al. | 450/21 |
| 3,746,008 | 7/1973 | LoCascio et al. | 450/74 |
| 4,289,137 | 9/1981 | Dell et al. | 450/58 |
| 4,393,875 | 7/1983 | O'Boyle et al. | 450/1 |
| 4,453,549 | 6/1984 | DiTullio | 450/74 |
| 4,917,651 | 4/1990 | Rainville | 450/58 |
| 5,045,019 | 9/1991 | Capasso et al. | 450/1 X |

*Primary Examiner*—Werner H. Schroeder
*Assistant Examiner*—Jeanette E. Chapman
*Attorney, Agent, or Firm*—Abelman Frayne & Schwab

[57] ABSTRACT

A brassiere construction has breast cups provided with a central diagonally extending panel that is stretchable in vertical directions, and which is non-stretchable in horizontal directions, thus to accommodate different volumes of breast tissue falling within a determined range of volumes.

8 Claims, 2 Drawing Sheets

MINIMIZING BRASSIERE

FIELD OF THE INVENTION

This invention relates to a brassiere that has the capability of visually minimizing the apparent size or volume of the female breast by the upwards repositioning of a portion of the volume of the breast.

BACKGROUND OF THE ART

Brassiere constructions in a myriad of forms are well-known in the art, including brassieres having breast cups in which selected areas are formed of different resistance to stretching than are other areas of the breast cups.

Typical of such a garment is the one shown in U.S. Pat. No. 4,289,137 issued Sept. 15, 1981. In that patent, a brassiere construction is taught in which an upper portion of the respective breast cups are comprised of an essentially non-stretchable fabric, the lower portions thereof being formed from a material that is stretchable in both vertical and horizontal directions. The purpose of the construction of this patent is to limit upward bounce of the breasts during jogging or similar athletic activities.

U.S. Pat. No. 2,701,362 issued Feb. 8, 1955 teaches a similar construction in which upper portions of the breast cups are sculpted to present a configuration in which the upper portion of the breast is confined, any excess volume of the breast being forced downwards and being permitted to bulge downwardly towards the wearer's waist line. In this way, a minimization of the visually observed breast volume is achieved, but, only at the expense of prohibiting the wearing of closely fitting outer garments that would reveal the downwards bulging of the breasts.

SUMMARY OF THE INVENTION

This invention has for its object to provide a brassiere construction in which a visual minimization of the volume of the breasts is achieved by uplifting a portion of the volume of the respective breasts along upwardly divergent paths leading towards the wearer's shoulder line. In this manner, a minimization of forward and downward displacement of the wearer's breasts is achieved, and instead, an uplifting and lateral displacement of the excess breast tissue is provided, thus presenting a youthful and cosmetically pleasing appearance to the wearer of the garment.

According to the present invention, the brassiere is provided with shoulder straps in the form of a halter that extends laterally across the wearer's sternum, the halter being formed of an essentially non-stretchable material.

Attached to the halter are one end of breast frames, and, the upper margin of breast cups, the frames being connected one with the other by a gusset of a material that is non-stretchable, both in vertical and horizontal directions.

Interconnecting the opposite ends of the frames and the shoulder straps is an edge binding formed from an elastic material, thus to provide the complete peripheral margin for the associated breast cup.

A plurality of panels, extend diagonally of each associated frame in divergent relationship, the respective panels being sewn at their edges to the edge of the adjacent panel, and, to the associated shoulder strap and the frame to provide a complete sculpted breast cup configuration.

In a preferred embodiment of the invention, there are three such panels, which, in combination, provide the entire sculpted breast cup. The outermost ones of those panels are formed from a fabric that is non-stretchable both in a vertical and in a horizontal direction. Interposed between the outermost panels is a central panel that extends diagonally of the breast cup, and which is formed of a fabric that has controlled stretchability in the vertical direction, and, which is non-stretchable in horizontal directions.

The brassiere is provided with the usual torso straps which are stretchable in a horizontal direction, and which are non-stretchable in a vertical direction, the torso straps being provided with connecting means at their free ends.

The shoulder straps extend from the upper margin of the associated breast cup, and then after extending over the shoulder of the wearer are connected to the torso straps, either directly, or, preferably through an elastic portion that is adjustably connected to the associated shoulder strap by a conventional fastener, such as by a buckle.

The top edge of the torso straps is bound with an elastic material, that continues into the elastic binding of the edge portion of the associated breast cup, and which is then sewn directly into the non-stretchable shoulder strap. Similarly, the lower edge of the torso straps can be bound with an elastic material.

In use of the garment, the breast cups are self-adjusting to accommodate breasts falling within a determined range of breast volume. Due to the connection of the non-stretchable shoulder strap to the associated frame, and due to the provision of the non-stretchable upper and lower panels of the breast cup, if the breast volume exceeds the lower volumetric limit, then, the central panel can stretch to accommodate the excess breast volume, while at the same time acting to lift the excess breast volume in a diagonally upwards and outwards direction towards the wearer's shoulder line.

The frame and the lowermost panel provide support for the weight of the breast, the upper panel providing for sculpting of the uppermost portion of the breast, the vertically stretchable central panel then providing control and a smooth transition between the upper and lower panels. Stretching of the central panel at its end attached to the frame is, of course, prohibited. However, throughout the length of the central panel and at the opposite edge thereof, vertical stretching can occur, the vertical stretching at the remote end of the central panel being accommodated by the elastic edge binding of that panel.

The central gusset panel is operative to inhibit movement of the respective breast frames away from each other, while at the same time, permitting hinging at the central position, sculpting of the cleavage, and, being operative to accommodate upwards or downwards movements of the wearer's shoulders.

As is well-known in the art, the directions of stretch of the fabrics comprising the upper, lower and central panels and the torso straps easily can be provided by combinations of fabrics that have been knitted on Raschel or Tricot machines. Such materials have the ability to simulate lace, and can have a knitted-in rear facing of a gauze-like material that is operative to inhibit vertical or horizontal stretching of what otherwise would be a readily stretchable lace fabric.

DESCRIPTION OF THE DRAWINGS

The invention will now be described with reference to the accompanying drawings, in which.

DESCRIPTION OF THE PREFERRED EMBODIMENT

Figure 1:
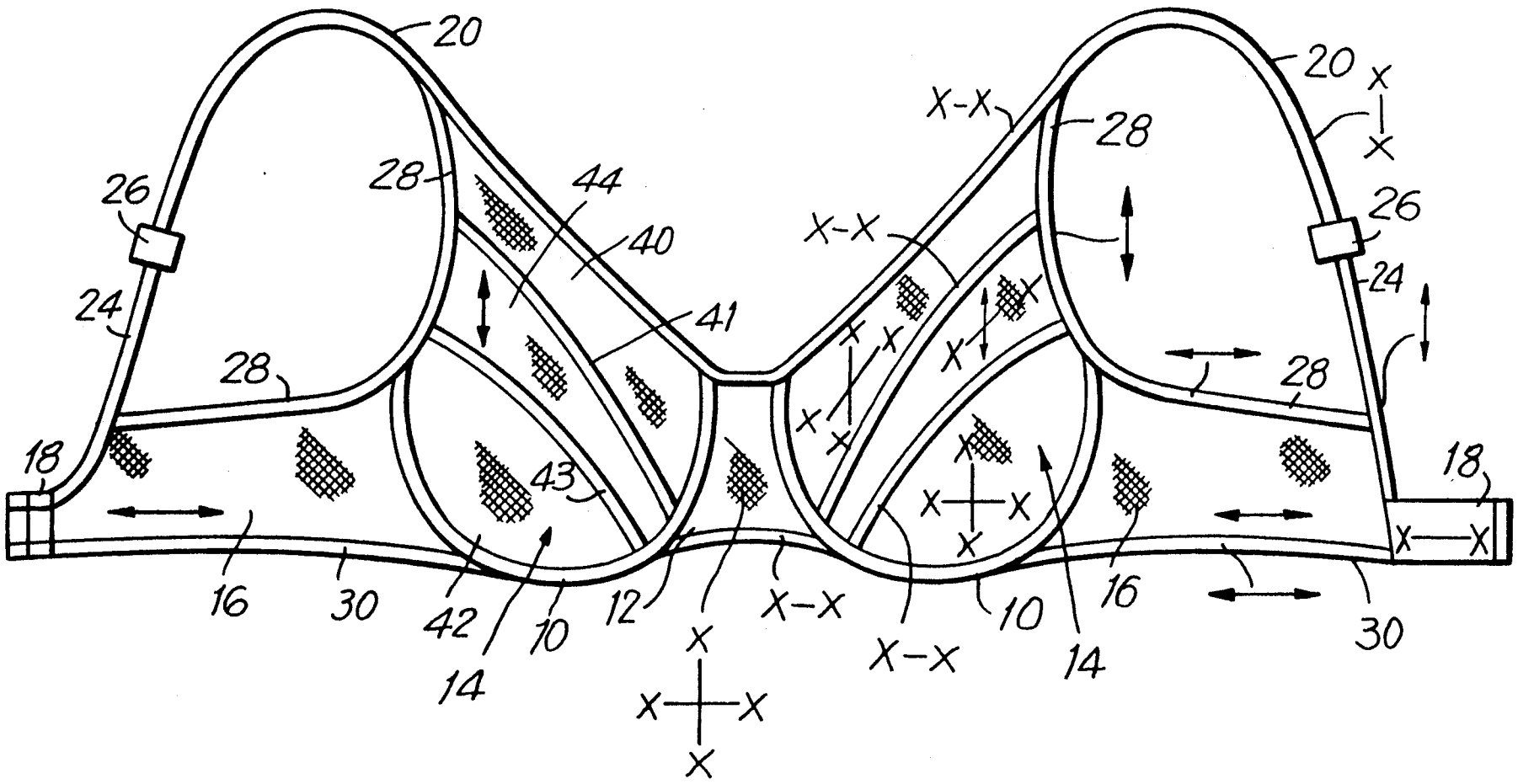
FIG. 1 is a frontal view of the garment of the invention, the rear view of the garment being generally similar, and differing only in the manner of stitching or overstitching.

As illustrated in FIG. 1, the brassiere of the present invention includes breast frames 10, the breast frames at one of their ends being interconnected by a gusset panel 12 formed from a material that has a high resistance to vertical or horizontal stretching, as is indicated by the stretch diagram 13. By virtue of the interconnection of the breast frames 10 by the gusset panel 12, movement of the breast frames away from each other in a horizontal direction is prohibited in its entirety, while at the same time allowing for hinging of the respective breast frames relative to each other in order to accommodate normal body movements of the wearer.

The opposite sides of the breast frames 10 are connected to torso straps 16, the torso straps being stretchable in a horizontal direction and being non-stretchable in a vertical direction. The torso straps 16, at their free end, terminate in conventional connectors such as hooks and eyes, Velcro or the like to permit adjustable attachment of the brassiere to the wearer's torso.

Extending between the adjacent upper ends of the breast frames 10 and the gusset panel 12, and then proceeding divergently upwardly and outwardly are shoulder straps 20 that are formed of a non-stretchable material, the shoulder straps continuing into adjustable elastic portions 24, which can be adjusted by means of conventional buckles or the like 26.

It will be observed that the shoulder straps, by virtue of them being formed from one continuous length of non-stretchable material provide a halter extending across the wearer's sternum, thus providing a structural support for the breast cups, indicated generally at 14, and, the weight of the contained breast tissue.

The respective breast cups each are formed of three panels which extend diagonally of the breast cups in downwardly convergent relation. The upper panel 40 and the lower panel 42 each are formed from a fabric that is non-strechable, both in vertical and horizontal directions, but which have give on the bias. The edge of the panel 40 adjacent to the shoulder strap 20 is sewn into the associated shoulder strap. The edge of the lower panel 42 adjacent to the breast frame 10 has the breast frame sewn into it, that panel and the associated breast frame also being sewn into the adjacent torso strap 16.

The central panel 44 is formed from a fabric dissimilar to that of the upper and lower panels 40 and 42, the fabric comprising the central panel 44 having controlled stretchability in a vertical direction, and being non-stretchable in horizontal directions.

The upper edge of the torso straps 16 is bound with elastic material, the elastic banding extending upwardly along the outermost edge of the associate breast cup and providing an edge binding for the associated breast cup at that location, the elastic material terminating in and being securely sewn into the associated shoulder strap 20.

Figure 2:
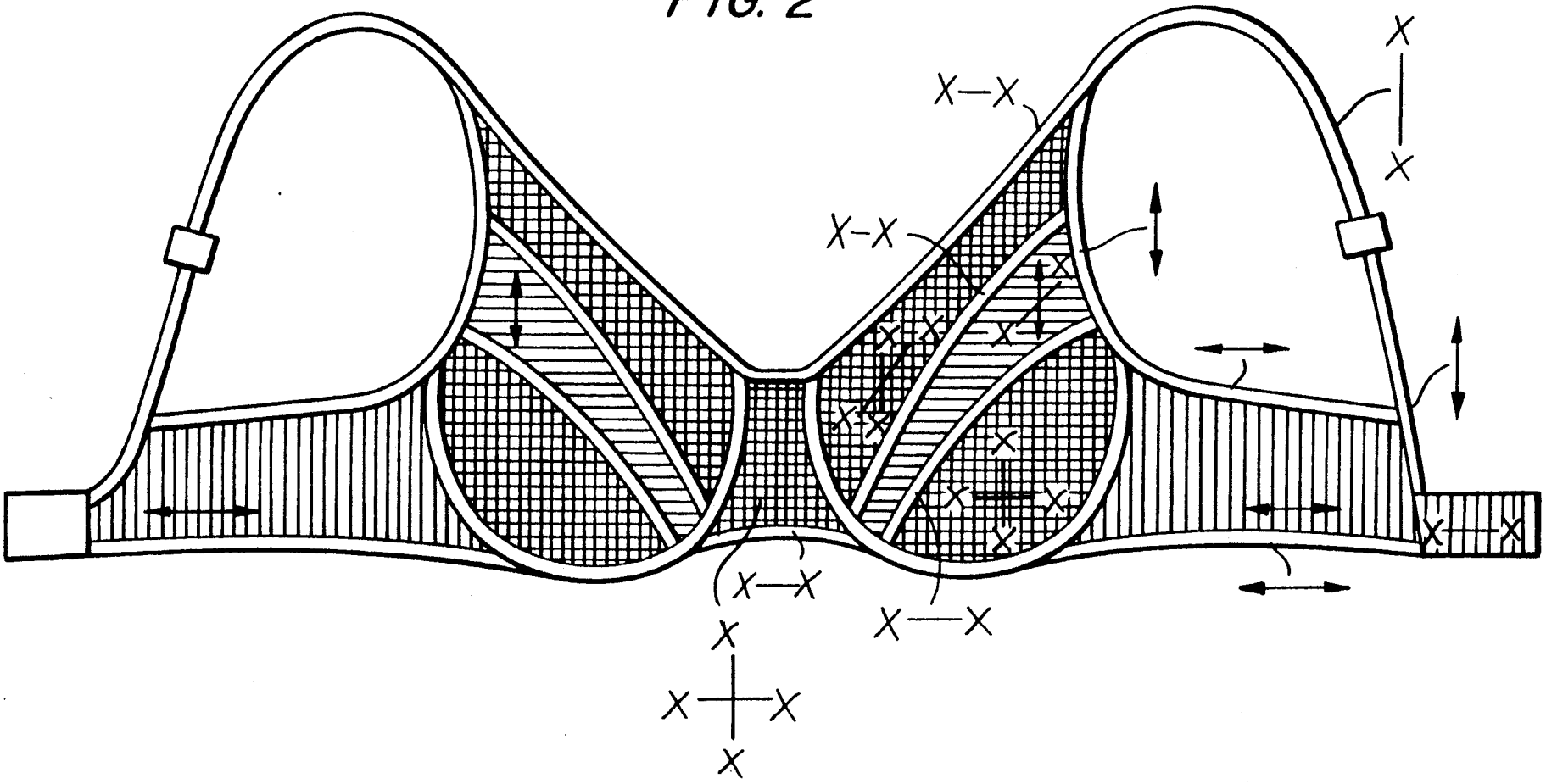
FIG. 2 is a diagrammatic view corresponding with FIG. 1, in which vertical and horizontal lines have been added to the various panels in order to illustrate the directions of non-stretchability of the respective panels.

FIG. 2 illustrates in diagrammatic form the specific directions in which the respective panels are non-stretchable, the directions of non-stretchability being indicated by solid vertical and horizontal lines.

The edges of the central panel 44 are securely sewn into the adjacent edges of the upper and lower panels 40 and 42, as indicated at 41 and 43.

In use of the garment, when secured in encircling relationship on the user's torso with the shoulder straps 20 extending over the wearer's shoulders and the breasts respectively received in the respective breast cups, the major weight of the breast is supported by the frame 10 and the lower panel 42 of the breast cup, the major weight of the breast being transmitted to the shoulder strap 20 at the interconnection of the breast frame 10 with the shoulder strap 20, this being further assisted by the central gusset panel 12 which is non-stretchable both in vertical and horizontal directions.

The upper panel 40 then extends across the upper surface of the wearer's breast to sculpt the upper surface. In the event that the breast tissue has greater volume than the initial volume of the breast cup before stretching, then the central panel 44 proceeds to stretch in a vertical direction, this allowing for a minor forwards movement of the breast tissue, but, predominantly resulting in a displacement of the excess volume of breast tissue diagonally and upwardly of the breast cup, the excess volume of breast tissue thus being displaced upwardly towards the wearer's shoulder line, the stretched central panel 44 then providing a smooth and uninterrupted transition between the upper and lower non-stretchable panels 40 and 42.

In this manner, the brassiere of the present invention can accommodate volumes of breast tissue falling within a specific range of volume with only minimal increase in size of the breast cups in the presence of a larger volume of breast tissue than can be accommodated in the breast cup prior to stretching of the central panel 44, thus providing a flattering minimizing effect, while at the same time, presenting a youthful and flattering appearance by the displacement of the excess volume of breast tissue along upwardly divergent paths as related to the cleavage, such displacement of the excess volume of breast tissue further being accommodated by the elastic edging 28 of the central panel 24, which permits forwards displacement of the edges of the upper and lower panels 40 and 42, thus to further enhance the effect of upwards displacement of the excess volume of breast tissue while sculpting the entire contour of the contained breast.

As will be apparent to persons skilled in the art, various materials can be employed in the construction of the brassiere, including lace fabrics that been knitted on a Raschel machine, and also, such lace fabrics that have been provided with a back facing of a non-stretchable gauze-like material, thus to provide minimal stretchability in both vertical and horizontal directions. Fabrics knit on a Tricot machine, and which have been provided with a faux facing of lace design can be employed for the material of the center panel 44, the lines of stitching between the respective edges of the upper and lower panels 40 and 42 and the adjacent edges of the panel 44 preferably being provided by stitching that will provide some give in the lines of stitching, thus to further enhance the smooth transition between the non-stretchable upper and lower panels 40 and 42 and the central stretchable panel 44, it here being noted that such bi-directionally non-stretchable materials do have a capability of stretching on the bias.

What is claimed is:

1. A brassiere construction having the capability of minimizing the visually-observed volume of contained breasts, comprising:

a halter providing shoulder straps, said halter being comprised of a length of non-stretchable material;

breast frames and breast cups suspended from said halter, said breast cups each comprising of a diagonally extending upper panel formed from a non-stretchable fabric material, a central diagonally extending panel formed from a fabric material permitting stretch in a vertical direction and being non-stretchable in horizontal direction, and a diagonally extending lower panel formed from a non-stretchable fabric material, said respective panels being secured to each other at their adjacent edges and being secured to said breast frames by stitching.

2. The brassiere of claim 1, including a gusset panel formed from a non-stretchable fabric material interposed between said breast frames and sewn into said breast frames.

3. The brassiere of claim 2, in which said gusset panel is also sewn into said halter.

4. The brassiere of claim 1, in which said respective central panels extend across said breast cups in downwardly convergent relationship relative to each other.

5. The brassiere of claim 1, including a length of elastic material incorporated into each said shoulder strap, and including adjustable fastener means permitting adjustment of the length of said elastic portion.

6. The brassiere of claim 1, including torso straps attached to an associated one of said breast cups and breast frames for positioning in encircling relation with a wearer's torso, and means at the free ends of said torso straps for interconnecting said torso straps.

7. The brassiere of claim 6, in which the torso straps are formed from a fabric material which is stretchable in horizontal directions, and which is non-stretchable in vertical directions.

8. The brassiere of claim 7, further including a binding of elastic material extending along an upper edge of each said torso strap, then extending upwardly along the adjacent edge of the associated breast cup, and then terminating and sewn into the associated said shoulder strap.

* * * * *